US005709229A

United States Patent [19]

Priehs et al.

[11] Patent Number: 5,709,229

[45] Date of Patent: Jan. 20, 1998

[54] METHOD OF PRODUCING A TOBACCO PRODUCT FOR SMOKING

[75] Inventors: Friedrich Priehs, Am Sonnenhang 3, D-28832 Achim; Dietrich Mueller, Hamburg, both of Germany

[73] Assignees: Friedrich Priehs, Achim; H.F. & Ph.F. Reemtsma GmbH & Co., Hamburg, both of Germany

[21] Appl. No.: 704,768

[22] PCT Filed: Jan. 28, 1995

[86] PCT No.: PCT/DE95/00109

§ 371 Date: Sep. 23, 1996

§ 102(e) Date: Sep. 23, 1996

[87] PCT Pub. No.: WO96/22706

PCT Pub. Date: Aug. 1, 1996

[51] Int. Cl.[6] ..... A24B 3/14

[52] U.S. Cl. ..... 131/375; 131/355

[58] Field of Search ..... 131/375, 355

[56] References Cited

U.S. PATENT DOCUMENTS

| | | | |
|---|---|---|---|
| 3,098,492 | 7/1963 | Wurzburg | 131/375 |
| 4,598,721 | 7/1986 | Stiller et al. | 131/375 |
| 4,632,131 | 12/1986 | Burnett et al. | 131/355 |
| 5,097,851 | 3/1992 | Ehling et al. | 131/375 |

FOREIGN PATENT DOCUMENTS

| | | | |
|---|---|---|---|
| 0 345 477 | 12/1989 | European Pat. Off. | 131/375 |
| 33 39 247 | 5/1985 | Germany | 131/375 |

*Primary Examiner*—Vincent Millin
*Assistant Examiner*—Charles W. Anderson
*Attorney, Agent, or Firm*—Foley & Lardner

[57] ABSTRACT

The invention relates to a method of producing a tobacco product for smoking. In order to develop a novel tobacco product for smoking, the following method steps are proposed:

a) a mixed mass of tobacco particles, starch or a starch-containing product as binder, and additives is produced;

b) the mixed mass is compressed and plasticized in an extruder by the application of thermal and mechanical energy;

c) pressurized steam is forced through the mixed mass so as to form channels;

d) on leaving the extruder, the plasticized mixed mass, rendered porous by the channels, is expanded or foamed by the drop in temperature and pressure, hardened as a continuous, porous, cylindrical rod and cut to the desired lengths.

16 Claims, No Drawings

METHOD OF PRODUCING A TOBACCO PRODUCT FOR SMOKING

BACKGROUND OF THE INVENTION

The invention relates to a method of producing a tobacco product for smoking.

DE-33 39 247 C1 discloses a method of producing crimped stranded articles from reprocessed tobacco, in which tobacco dust and/or tobacco waste is processed with binders, and optionally additives, to form a plasticizable mixture. In an extruder, a cylindrical rod of the plasticized mixture is converted into a thin-walled, continuously widening hollow body and divided into elongate, crimped intermediate products which are then separated into individual crimped stranded articles.

DE-38 19 534 C1 discloses a method of producing homogenized tobacco leaf articles from reprocessed tobacco. In this case, particulate tobacco waste and/or tobacco powder is mixed with binders, and optionally additives, and the mixture thus obtained is plasticized in an extruder. The plasticized mixture is distributed, via extrusion paths of exactly equal length, into an even number of mechanically and geometrically identical cylindrical rods. Each pair of identical adjacent rods is rolled together to form a homogenized tobacco leaf billet which is then cut up into the homogenized leaf articles. The mixture is plasticized in the extruder at temperatures of 90° to 120° C. and pressures of 50 to 100 bar. The cylindrical rods have a diameter of 2 to 7 mm.

DE-40 05 656 A1 describes a method of producing of a tobacco-containing homogenized leaf product with enhanced consistency. In this case, a raw mass with a tobacco content of about 86 to 98% by weight is mixed with humectants in a proportion of about 1 to about 6% by weight and binders in a proportion of about 1 to about 8% by weight, with a water content in the ratio of 80:20 to 60:40. The wet raw mass is then extruded in an extruder with a temperature profile of about 30° C. to about 160° C. at a pressure of about 10 to about 200 bar, and is pressed through a nozzle provided with an outlet slit, which produces the homogenized tobacco leaf. This homogenized tobacco leaf is then vigorously heated on both sides, as a result of which substantially gas-impermeable cover layers form on the homogenized tobacco leaf. By means of a further vigorous supply of heat, the water contained in the homogenized tobacco leaf is vaporized between the cover layers, which produces bubble-like cavities.

SUMMARY OF THE INVENTION

The object of the invention is to develop a novel tobacco product for smoking and a method for its production.

This object is achieved according to the invention by carrying out the following method steps:

a) a mixed mass of tobacco particles, starch or a starch-containing product as binder, and additives is produced;

b) the mixed mass is compressed and plasticized in an extruder by the application of thermal and mechanical energy;

c) pressurized steam is forced through the mixed mass so as to form channels;

d) on leaving the extruder, the plasticized mixed mass, rendered porous by the channels, is expanded or foamed by the drop in temperature and pressure, hardened as a continuous, porous, cylindrical rod and cut to the desired lengths.

DETAILED DESCRIPTION OF PREFERRED EMBODIMENTS

The channels produced by injecting steam into the mixed mass remain in the form of longitudinal and radial channels in the extruded rod. When this rod is smoked, the same process as in a conventionally produced tobacco rod takes place, with the difference that the combustion air is sucked through the set air channels instead of through gaps in the comminuted tobacco. Nevertheless, the rod produced according to the invention is also air-permeable enough for the combustion air during smoking to be sucked uniformly through the cross section of the rod and the length of the rod, without the suction resistance then provided by the rod exceeding an upper value.

Native and/or modified starch may be used as binder, the binder proportion being advantageously about 15% by weight.

Humectants such as glycerol, molasses and/or other hygroscopic substances may be admixed as additives.

Furthermore, burning enhancers may be provided as additives, for example organic acids for making the ash burn white, and/or carbonates or wetting agents for improving burning qualities.

Finally, flavorings and/or spices may also be provided as additives, for example flavoring precursors, extracts and steam-distillates of matured leaves of plants other than tobacco plants.

Further advantageous additives are biologically based film-forming adjuvants. In order to accelerate the processing in the extruder, polyvinyl alcohol (PVA) or polyvinyl acetate (PVAC) may be added to the mixed mass. This produces improved foaming with good elasticity or flexibility of the mixed mass. As regards the preferred modes of application of PVA, reference may be made to the description in DE-40 08 862 C1.

According to the invention, genetically engineered adjuvants may also be employed.

In order to produce the channels required for smoking, a steam pressure of 50–120 bar, preferably about 80 bar, is selected.

The tobacco particles used for the mixed mass may be produced by comminuting matured tobacco leaves, but may also be waste from conventional tobacco processing. In this case, use is preferably made of tobacco particles with a screen size of approximately 3 to 5 mm.

Normally packaged matured tobacco has undergone an elaborate biochemical development: even before the leaves are harvested, the tobacco undergoes breakdown in the field, and this is continued after harvesting in increased yellowing, drying and fermentation. The chemistry of the maturing is essentially dependent on the rate of water loss being as slow as possible. The concentrations of starch and protein which are relatively high initially in the living state are hydrolyzed with a still high water content of up to about 80% by weight and are converted into soluble sugars and nitrogen compounds. At a water content of less than 80%, the enzymes initiating these processes are inactive, and so-called leaf death sets in. In order to allow the full effect of the maturing to be achieved, it is therefore desirable to carry out the drying within 100 hours; during this time, the temperature is increased from 32° C. to 80° C. and the relative humidity is reduced from 80% to 10% with an increasing rise in the ventilation.

Since such conditions can only very seldom be reached reliably when the tobacco leaves are left in a natural atmosphere, such a treatment is generally possible only in a controlled environment. It is further-more plausible that the effect of the artificially sought optimum maturing conditions is enhanced as the surface area and volume of the leaf substance to be treated becomes smaller and more finely dispersed.

On the basis of these discoveries, the invention now proposes, in order to produce the tobacco particles for the above-described mixed mass, to use and comminute still unmatured tobacco leaves, and then to carry out the maturing of the tobacco in the extruded rod, that is to say in the almost finished product. To this end, the rod sections produced according to the invention are conditioned in a ventilated climatized environment, that is to say in air-permeable containers in climatized chambers. In this case, the conditioning is carried out until a final moisture content in the rod of about 10 to 13% at about 50° C. In this state, transfer to the final manufacturing state then takes place:

The so-called aging consists in storage of the rod sections over a period of about 0.5 to 2 years at 20° C. and 60 to 75% relative humidity. The final packaging then takes place.

An advantage in this method according to the invention consists, on the one hand, in that the steam-treatment can have an essential influence on the tobacco maturing. Furthermore, on the other hand, the still relatively high native starch content can be exploited in the preparation method. Finally, this method opens up the possibility that whole plants, and not only their leaves at only a medium degree of maturity, can be harvested, comminuted and then subjected to the process according to the invention. In this case, the relatively high amount of water retained in the form of waters of imbibition in the whole plants can also be advantageously used.

With the novel method, the production of entirely novel cigarettes can be automated virtually completely from the tobacco plant to the end product.

We claim:

1. A method of producing a tobacco product for smoking comprising:

a) mixing tobacco particles, starch or a starch-containing product as binder, and additives to produce a mixture;

b) compressing and plasticizing the mixture in an extruder by the application of thermal and mechanical energy;

c) forcing pressurized steam through the mixture so as to form channels;

d) on leaving the extruder, expanding or foaming the mixture, rendered porous by the channels by a drop in temperature and pressure, hardening said mixture to form a continuous, porous, cylindrical rod and cutting said rod to desired lengths to form rod sections.

2. A method according to claim 1, wherein native or modified starch is used as binder.

3. A method according to claim 1, wherein the binder is used in a proportion of about 15% by weight.

4. A method according to claim 1, wherein tobacco particles are used with a screen size of approximately 3 to 5 mm.

5. A method according to claim 1, wherein humectants are admixed with said tobacco particles and said starch or said starch-containing product as the additives.

6. A method according to claim 1, wherein burning enhancers are admixed with said tobacco particles add said starch or said starch-containing product as the additives.

7. A method according to claim 1, wherein flavorings and/or spices are admixed with said tobacco particles and said starch or said starch-containing product as the additives.

8. A method according to claim 1, wherein biologically based film-forming adjuvants are admixed with said tobacco particles and said starch or said starch-containing product as the additives.

9. A method according to claim 1, wherein in order to accelerate processing in the extruder, polyvinyl alcohol or polyvinyl acetate is added to the mixture.

10. A method according to claim 1, wherein genetically engineered adjuvants are admixed with said tobacco particles and said starch or said starch-containing product as the additives.

11. A method according to claim 1, wherein the steam pressure of said pressurized steam is 50–120 bar.

12. A method according to claim 1, wherein the tobacco particles used for the mixture are produced by comminuting matured tobacco leaves and/or are waste from conventional tobacco processing.

13. A method according to claim 1, wherein unmatured tobacco leaves are comminuted to produce the tobacco particles, and the tobacco particles are matured in the cylindrical rod.

14. A method according to claim 13, wherein said rod sections are used for tobacco maturing by conditioning said rod sections in a ventilated, climatized environment.

15. A method according to claim 14, wherein after said cutting, conditioning in a ventilated, climatized environment takes place at about 50° C. until the moisture content in said rod sections is from 10 to 13%.

16. A method according to claim 15, wherein, after they have been conditioned, the rod sections are stored for 0.5 to 2 years at about 20° C. and 60 to 75% relative humidity.

* * * * *